US005786760A

United States Patent [19]

Suzuki et al.

[11] Patent Number: 5,786,760

[45] Date of Patent: Jul. 28, 1998

[54] ALARM SYSTEM WITH VARIABLE WARNING SIGNAL

[76] Inventors: Tomohiko Suzuki, 2-5-1 Kaminarimon #1003, Taitoh, Tokyo 111, Japan; Shu Tokuyama, 5701 Spring Oak Dr., Los Angeles, Calif. 90028

[21] Appl. No.: 610,346

[22] Filed: Mar. 4, 1996

[30] Foreign Application Priority Data

Mar. 8, 1995 [JP] Japan ..... 7-048335

[51] Int. Cl.[6] ..... G08B 13/00

[52] U.S. Cl. ..... 340/541; 340/384.3; 340/555; 340/691; 342/27

[58] Field of Search ..... 340/691, 692, 340/395, 328, 384.3, 541, 545, 555–557, 529, 523, 815.83; 342/450, 27–28; 367/93–94

[56] References Cited

U.S. PATENT DOCUMENTS

| | | | |
|---|---|---|---|
| 4,142,187 | 2/1979 | Nakayama | 340/554 |
| 4,568,920 | 2/1986 | Mombelli | 340/545 X |
| 4,571,583 | 2/1986 | Giordano | 340/692 |
| 4,642,612 | 2/1987 | Crump | 340/541 |
| 4,651,144 | 3/1987 | Pagano | 340/541 X |
| 4,679,034 | 7/1987 | Kamada | 340/691 X |
| 4,970,489 | 11/1990 | Jenkins et al. | 340/692 X |
| 5,532,680 | 7/1996 | Ousborne | 340/692 X |

*Primary Examiner*—Thomas Mullen
*Attorney, Agent, or Firm*—Jeffrey L. Thompson

[57] ABSTRACT

An alarm system and method for detecting an intruder and making an impression on the intruder. The system operates by detecting a presence of the intruder, determining a location of the intruder, outputting a warning signal for perception by the intruder, and changing the warning signal based on the determined location of the intruder and/or a predetermined passage of time. The system provides means for changing an audio level of the warning signal gradually so as to give the intruder an impression that an audio source is moving toward the intruder. In a preferred embodiment, the warning signal is output over a plurality of speakers, and a phase and audio level of the warning signal output from a first speaker is changed relative to a phase and audio level of the warning signal output from a second speaker so as to give the intruder an impression that an audio source is moving two dimensionally toward the intruder. The kind of warning signal can be changed based on a predetermined passage of time or on the calculated position of the intruder. The system provides an effective alarm system by giving intruders the impression that vital beings have detected their intrusion.

18 Claims, 6 Drawing Sheets

ALARM SYSTEM WITH VARIABLE WARNING SIGNAL

BACKGROUND OF THE INVENTION

1. Field of the Invention

The present invention relates generally to alarm and warning systems and, in particular, to an alarm or warning system that provides a variable warning signal to give an intruder an impression that his intrusion has been detected by human beings, dogs, or the like.

2. Description of the Related Art

Conventional alarm and warning systems have a primary purpose of letting an intruder know that his intrusion has been detected. These systems accomplish this purpose by outputting sound or light as an alarm or warning signal. Alarm systems often have a secondary purpose of notifying an owner of protected property that a trespass to his property is occurring. As used in this application, the phrase "alarm system" will be used interchangeably with the phrase "warning system."

Traditionally, the sound output by an alarm system is through non-vital equipment, such as a siren sound. However, if the alarm output is made by such non-vital equipment, the intruder usually recognizes that the sound is simply a mechanical sound. Thus, the intruder may be confident that the detection is not necessarily made by human beings.

To address this problem and provide a more effective alarm system, systems have been developed that output sounds that simulate sounds of a vital being, such as human or dog voices. Although the alarm sound simulates vital beings, an intruder may come to know that the sound is just a simple alarm if the sound is simply repeated or gives the impression that it is coming from a fixed location.

SUMMARY OF THE INVENTION

It is an object of the present invention to solve the problems described above in existing alarm systems. More specifically, it is an object of the present invention to provide an alarm system that gives an intruder an impression that his intrusion has been detected by human beings, dogs, or the like.

It is a further object of the present invention to provide an alarm system with a variable output signal that gives an intruder an impression that a source of the alarm or warning signal is moving.

It is yet a further object of the present invention to provide a method for protecting a desired location using a variable warning signal that gives an intruder an impression that his intrusion has been detected by human beings, dogs, or the like.

Additional objects, advantages and novel features of the invention will be set forth in part in the description which follows, and in part will become more apparent to those skilled in the art upon examination of the following or may be learned by practice of the invention. The objects and advantages of the invention may be realized and attained by means of the instrumentalities and combinations particularly pointed out in the appended claims.

To achieve the stated and other objects of the present invention, as embodied and described below, the invention comprises an alarm system and method for detecting an intruder and making an impression on the intruder. The system operates by detecting a presence of the intruder, determining a location of the intruder, outputting a warning signal, and changing the warning signal based on the determined location of the intruder and/or a predetermined passage of time. The system also provides means for changing an audio level of the warning signal gradually so as to give the intruder an impression that an audio source is moving toward the intruder.

In a preferred embodiment, the warning signal is output over a plurality of speakers, and a phase and audio level of the warning signal output from a first speaker is changed relative to a phase and audio level of the warning signal output from a second speaker so as to give the intruder an impression that an audio source is moving two dimensionally. In this manner, the phase and audio level of the warning signal can be precisely controlled to give the intruder an impression that an audio source is moving toward the intruder. The kind of warning signal can be changed based on a predetermined passage of time or on the calculated position of the intruder.

By using electronically simulated human voices or dog sounds as the warning signal, the system provides an effective alarm system by giving intruders the impression that vital beings have detected the intrusion. The intruder is thus encouraged to exit the protected region.

BRIEF DESCRIPTION OF THE DRAWINGS

The accompanying drawings, which are incorporated in and form a part of the specification, illustrate the present invention and, together with the description, serve to explain the principles of the invention. In the drawings.

DETAILED DESCRIPTION OF THE PREFERRED EMBODIMENT

Using the drawings, the preferred embodiments of the present invention will now be explained.

Figure 1:
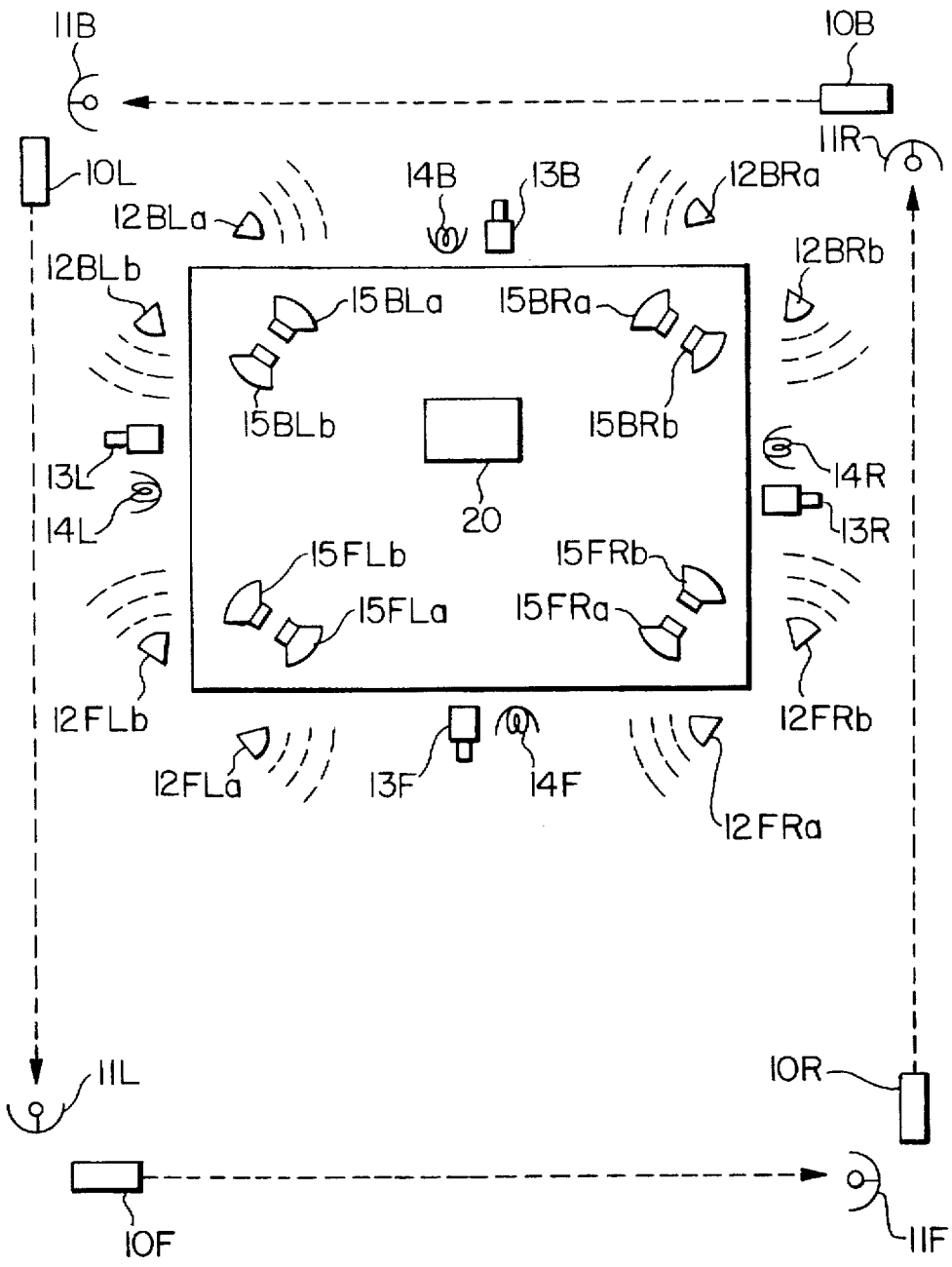
FIG. 1 is a system diagram of an alarm system according to a preferred embodiment of the present invention.

FIG. 1 is a system diagram that shows the overall layout of components for an alarm system according to a preferred embodiment of the present invention.

In the FIG. 1, a building 100 (e.g., a house) is surrounded by fences on four sides. Each fence has infrared lights 10 and infrared sensors 11 that receive infrared light from infrared lights 10. In the illustrated example, intruders can come inside of the fence from any direction, from the left or right side fence, or the front or back fence. Regardless of the direction the intruders come from, they are detected by a corresponding one of the infrared sensors 11F, 11R, 11B, and 11L.

The building 100 is surrounded by radars 12FLa that cover the area of the front-left side to the right side of the house building 100, radars 12FLb that cover the area of the front-left side to the back side of the house 100, radars 12FRa that cover the area of the front-right side to the left side, radars 12FRb that cover the area of the front-right side to the back side, radars 12BRb that cover the area of the back-right side to the front side, radars 12BRa that cover the area of the back-right side to the back-left side, radars 12BLa that cover the area of the back-left side to the back-right side, and radars 12BLb that cover the area of the back-left side to the front-left side.

These radars 12 are put into operation when one of the infrared sensors 11 detect an intruder. The radar system detects and monitors the positions of the intruder as the intruder moves around inside of the fence. The radar system can be programmed and adapted to monitor more than one intruder.

The system also has cameras 13 for watching the intruder and monitoring and/or recording the movement of the intruder. For example, the camera 13F takes pictures of the front area of the house 100 where the area is lighted up by the light emitter or the beam light 14F.

Inside of the building 100, speakers are located at eight locations in the illustrated embodiment. Specifically, a speaker 15FLa puts out sound to the area from front-left to right-front, a speaker 15FLb puts out sound to the area from front-left to left-backward, a speaker 15FRa puts out sound to the area from front-right to left-front, a speaker 15FRb puts out sound to the area from front-right to right-backward, a speaker 15BLb puts out sound to the area from backward-left to front-left side, and a speaker 15BLa puts out sound to the area from backward-right to backward-left side.

Figure 2:
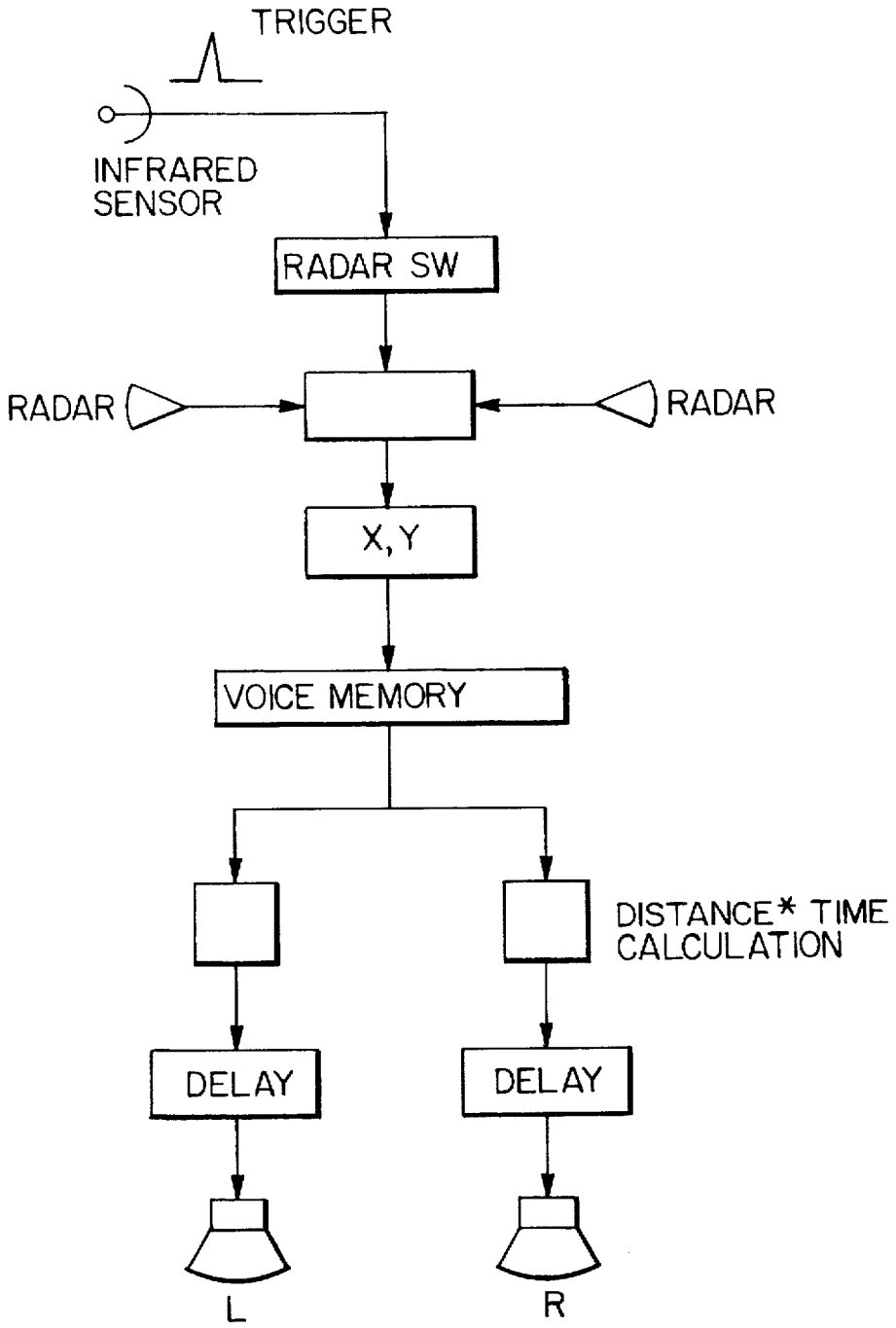
FIG. 2 is a system flow chart of the present invention showing an operation of the alarm system upon detection of an intruder.

Referring to FIG. 2, an operation of the alarm system shown in FIG. 1 will be described. As shown in FIG. 2, when an input to one of the infrared sensors 11 (for example, the front sensor 11F) indicates an intruder, this input places the radar system into operation via a radar switch SW. For example, the pair of radars 12FLa and 12FRa that corresponds to the infrared sensor 11F will be put into operation when an intruder is detected by the infrared sensor 11F.

Figure 3:
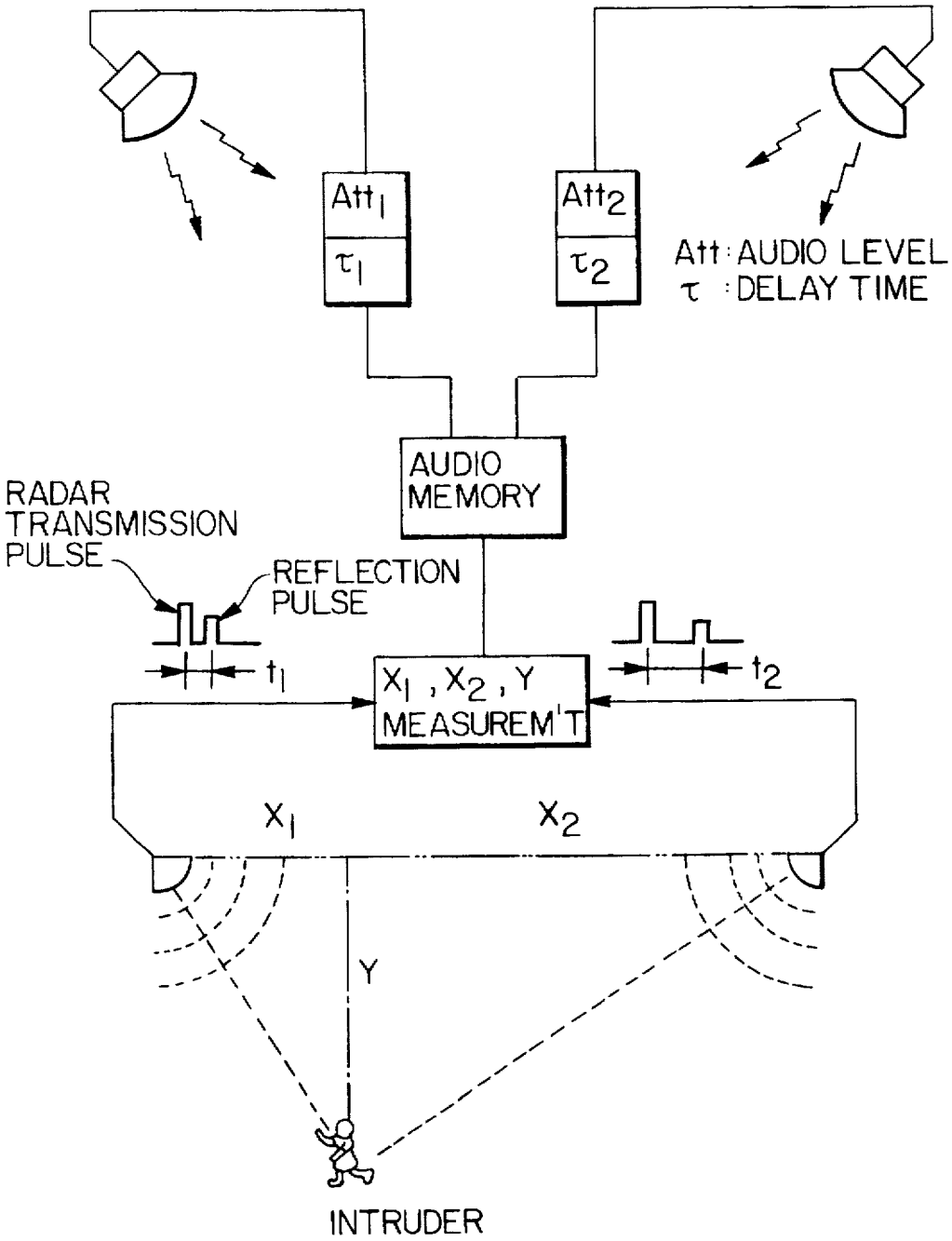
FIG. 3 is a system diagram showing an operation of a radar system for determining and monitoring a location of an intruder.

The controller 20 determines the location of an intruder by analyzing the signal output from the radars 12. The location of the intruder is shown by the distances (X1, X2, Y) from a specific pair of radar units, as shown in FIG. 3 of the drawings. The formulae for determining the distances $X_1$, $X_2$, and Y are expressed as follows:

$$x_1 = \frac{1}{2}\left\{ l + \frac{v^2}{l}(t_1^2 - t_2^2) \right\}$$

$$x_2 = \frac{1}{2}\left\{ l - \frac{v^2}{l}(t_2^2 - t_1^2) \right\}$$

$$y = \frac{1}{2l}\sqrt{2v^2l^2(t_1^2 + t_2^2) - l^4 + v^4(t_1^2 - t_2^2)^2}$$

The location of the intruder is determined by the radar units nearest to the intruder. Based on the intruder's location, the system outputs synthesized voice data (for example, the voice of a human, dog or the like) out of a voice memory in the controller 20. The voice memory providing the voice data can be in the form of a conventional magnetic recording tape, disk, sound card, or other suitable device.

The present invention calculates the distances between the closest pair of speakers and the intruder. More than two speakers can also be used and coordinated by the present invention. Once the intruder's position is calculated relative to the appropriate speakers, the synthesized voice data is processed and output from the speakers as if a dog or the like is approaching the intruder. The controller 20 of the present invention processes the synthesized voice data by varying an output level (audio level Att) and phase (delay time τ between left and right side) of the appropriate speakers.

Figure 4:
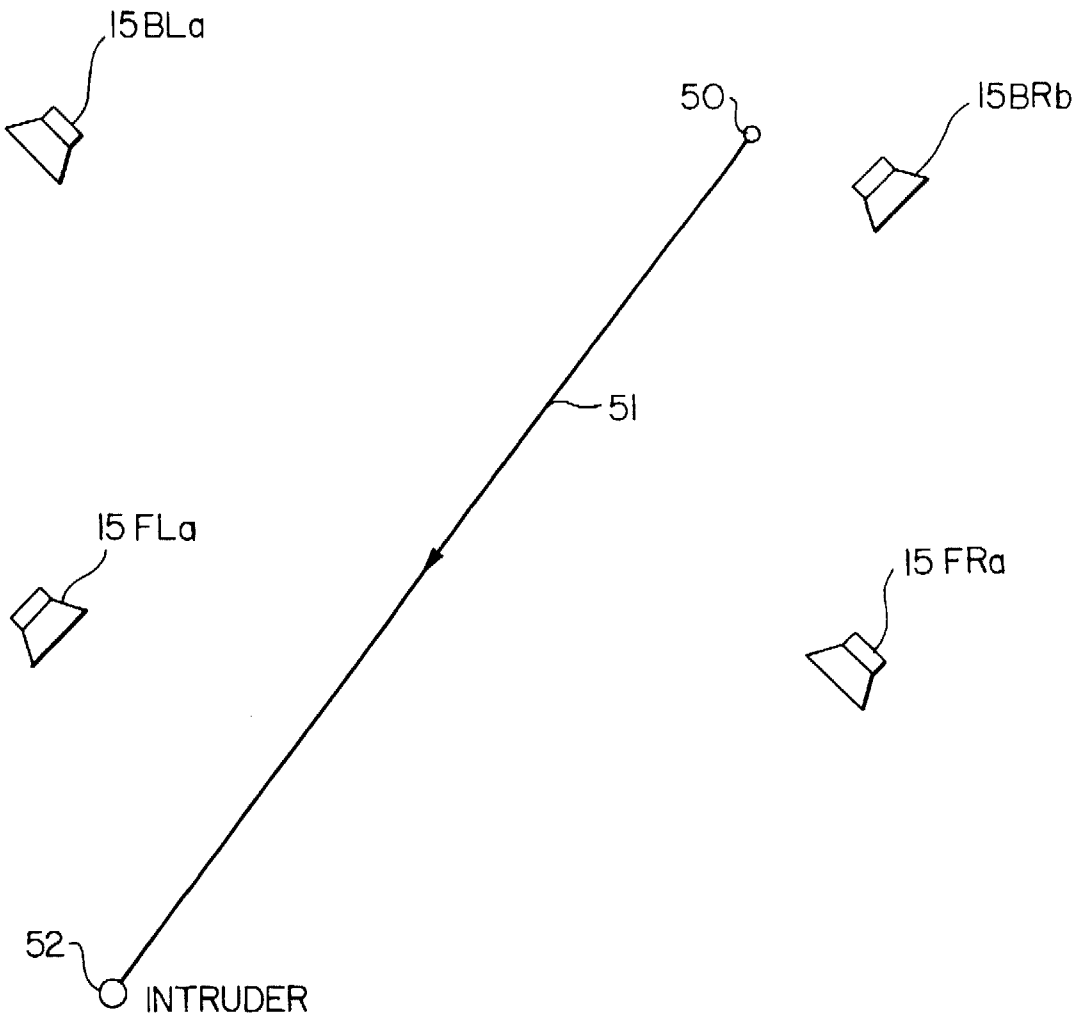
FIG. 4 is a diagram illustrating a simulated movement of a sound source toward an intruder.

Referring to FIG. 4, two pair of speakers (15FLa, 15FRa, 15BLb, 15BRb) are shown on opposite sides of an imaginary line between points 50 and 52. The controller 20 (FIG. 1) of the present invention processes voice data by controlling and varying the voice signal level and phase to give an impression to the intruder at the position 52 as if a sound source (e.g., a non-existing human or dog) exists, and that the source is moving from position 50 toward position 52.

By controlling the voice audio level Att from the four speakers (15FLa, 15FRa, 15BLb, 15BRb) gradually, without controlling a phase (delay time τ) of the signal, it is possible to give an impression to the intruder as if the voice source (e.g., a non-existing dog) exists and that the source is moving. However, a more effective result is achieved by varying both the phase τ and the audio level Att.

Figure 5:
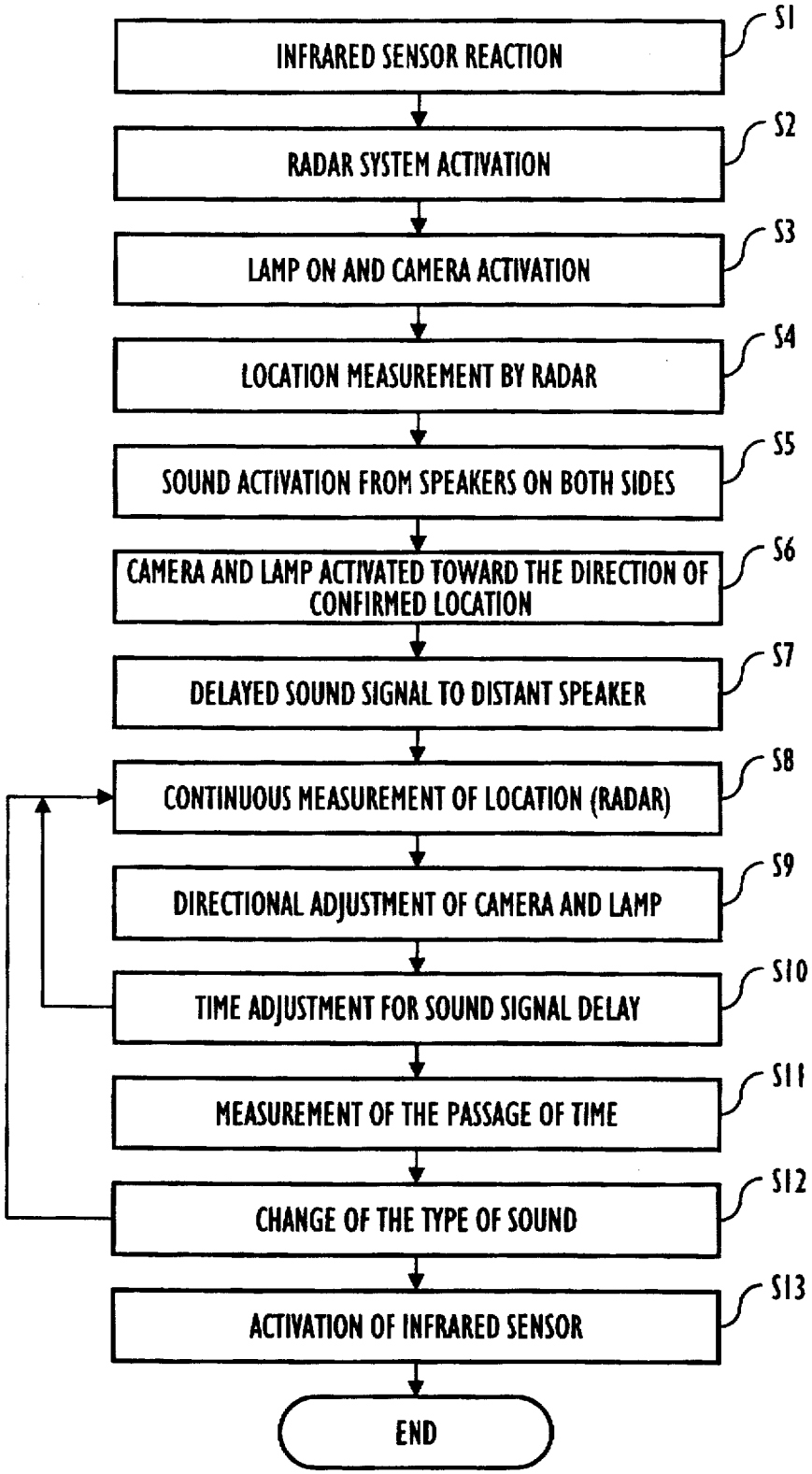
FIG. 5 is a flow chart of the method steps used by the preferred embodiment of the alarm system according to the present invention.

FIG. 5 shows a practical control process of the controller 20 of the alarm system shown in FIG. 1. The control process is characterized by the following steps:

Step 1 (S1): Information is obtained regarding the intruder's existence, including information as to which side of the house is being invaded, by the infrared sensor.

Step 2 (S2): The radar system is activated. Rough information is already obtained by the infrared sensors regarding which direction an intruder came in. To find out the intruder's position more precisely, plural pairs of radar systems can be activated.

Step 3 (S3): Light beams or light emitting systems are activated and pictures are taken by cameras.

Step 4 (S4): The position/location of the intruder is measured based on the signal from the radars that have been activated by Step 2 (S2).

Step 5 (S5): Sound is output from selected right and left speakers based on the intruder's location. More than two speakers can be used, as necessary.

Step 6 (S6): Based on the position data of the intruder in the Step 4 (S4), beam lights and cameras are directed to the intruder.

Step 7 (S7): To have stereo effect in the sound coming from the speaker pairs, the sound output from a speaker located further from the intruder is adjusted to a different phase (delay in time) as compared to the sound output from the speaker located closer to the intruder.

Step 8 (S8): The measurement of location of the intruder is continuously made.

Step 9 (S9): Adjustment of the directions of the beam of lights and cameras are made according to the location of the intruder, as measured in Step 8 (S8).

Step 10 (S10): Sound level and phase adjustment of the sound signal is continuously made based on the location of the intruder, as measured in Step 8 (S8). By adjusting the sound level and phase adjustment of the sound coming from the speakers based on the intruder's movement, the intruder will recognize the existence of the sound source, which is a dummy source, and the apparent movement of the dummy sound source.

Step 11 (S11): The passage of time from the initial triggering of the alarm system is measured.

Step 12 (S12): The dummy sound source is controlled and changed based on the measured passage of time in Step 11 (S11). For example, the kind of voice sound can be changed in Step 12 (S12) based on the measured passage of time. The change of the kind of voice sound, for example, means that at the beginning of the cycle, the voice of a smaller or quieter dog is output, and at the end of the cycle, the voice sound is changed to a louder voice or the voice of a larger dog. This change greatly increases the threat to the intruder.

Using the principles described above, a number of different variations of the present invention are possible. For example, the radar sensors 12 described above can utilize either supersonics or electromagnetic waves to detect and pinpoint intruders. The location of the intruder can be determined by utilizing Doppler effect in the electromagnetic wave output from the radars, which waves are modulated in a pulse width modulation system or a frequency modulation system. The location of the intruder can also be determined and monitored electronically through a video processing system in communication with the cameras 13.

In the application example stated above, time difference or phase difference adjustment between two speakers on the right and left sides is preferably in the range of micro-second order to generate a stereo quality for more closely simulating a moving sound source. The sound source is preferably simulated electronically, and the preferred method of outputting the sound is through audio speakers placed in strategic locations.

Figure 6:
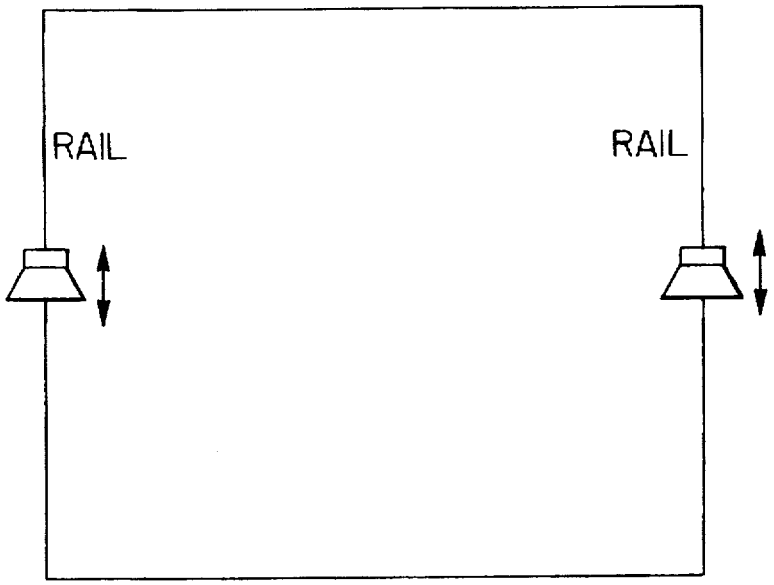
FIG. 6 is a diagram showing a second embodiment of the present invention in which audio speakers are placed on guide rails for movement relative to a detected intruder.

The locations of the audio speakers can be fixed or movable, depending on the particular application. For example, as shown in FIG. 6, two speakers can be put on guide rails for physical movement along the guide rails. The use of movable speakers also gives an impression to the intruder that the sound source is moving, although the sound is simulated electronically. However, the movement of speakers is limited to the position of the guide rails. To give an impression to the intruder that the sound source is approaching toward him at its own will, the sound out of the speakers should be controlled or adjusted in its audio level Att and phase shift $\tau$ (delay time).

The present invention is not limited to detecting and warning against human intruders. The invention can also be applicable to scare away animals that disturb agricultural products, pets, and so forth.

The kind of voice or sound that is output over the audio speakers of the present invention can be any suitable sound and is not restricted to a particular type of voice or animal sound. For example, a dog voice may be an effective output for an alarm system when an intruder is detected in a small, relatively closed place, but a dog voice may not be effective from a long distance. As the intruder gets closer to protected areas, the alarm system of the present invention can be set to output a shouting voice, a louder dog voice, and so forth.

The perceived sound movement of the present invention is not limited to two dimensional voice sound movement. The system can also provide the perception to intruders that the source of a sound is moving in three dimensions by locating speakers three dimensionally (i.e., at least one speaker at a different height relative to the other speakers) and controlling the phase and amplitude shifts of the speakers accordingly.

The present invention is also not limited to the use of a sound source as an alarm or warning signal. For example, the alarm or warning signal can also be a light signal. The light signal can be provided by light sources located strategically throughout an area to be protected, and the control system can be set to selectively turn lights on and off based on the detected location of an intruder. For example, the control system can methodically turn on lights throughout a building as if a person in the building were approaching the intruder's location.

As explained above, the alarm system of the present invention provides impressions to moving objects, such as intruders, that vital beings, such as human beings or dogs, exist in a protected area, and that the vital beings have detected the presence and location of the intruder.

The above description has been presented only to illustrate and describe preferred forms of the invention. It is not intended to be exhaustive or to limit the invention to any precise form disclosed. Many modifications and variations are possible in light of the above teachings.

The preferred embodiment was chosen and described in order to best explain the principles of the invention and its practical application to enable others skilled in the art to best utilize the invention in various embodiments and with various modifications as are suited to the particular use contemplated. It is intended that the scope of the invention be defined by the following claims.

What is claimed is:

1. A method for detecting an intruder and making an impression on the intruder, comprising the steps of:

detecting a presence of the intruder;

determining a location of the intruder by placing a plurality of sensors throughout an area to be protected and calculating the location of the intruder using output signals transmitted from the sensors;

outputting a warning signal for perception by the intruder; and changing the warning signal based on the determined location of the intruder.

2. The method of claim 1, further comprising the step of changing the warning signal based on a predetermined passage of time.

3. The method of claim 1, further comprising the step of changing an audio level of the warning signal gradually so as to give the intruder an impression that an audio source is moving.

4. The method of claim 1, wherein said step of detecting the presence of the intruder is performed by detecting a break in a path of an infrared light beam.

5. The method of claim 1, wherein said step of determining the location of the intruder is performed by monitoring the intruder's movement using a plurality of radars.

6. The method of claim 1, wherein a kind of warning signal is selected from the group consisting of a human voice, a dog voice, and a light source, and further comprising the step of changing the kind of warning signal output based on the determined location of the intruder.

7. A method for detecting an intruder and making an impression on the intruder, comprising the steps of:

detecting a presence of the intruder;

determining a location of the intruder;

outputting a warning signal for perception by the intruder;

changing the warning signal based on the determined location of the intruder; and changing an audio level of the warning signal gradually so as to give the intruder an impression that an audio source is moving;

wherein the audio level of the warning signal is increased so as to give the intruder an impression that an audio source is moving toward the intruder.

8. A method for detecting an intruder and making an impression on the intruder, comprising the steps of:

detecting a presence of the intruder;

determining a location of the intruder;

outputting a warning signal for perception by the intruder;

changing the warning signal based on the determined location of the intruder; and changing an audio level of the warning signal gradually so as to give the intruder an impression that an audio source is moving;

further comprising the steps of outputting a warning signal over a plurality of speakers, and changing a phase and audio level of the warning signal output from a first speaker relative to a phase and audio level of the warning signal output from a second speaker so as to give the intruder an impression that an audio source is moving two dimensionally.

9. The method of claim 8, wherein the phase and audio level of the warning signal are controlled to give the intruder an impression that an audio source is moving toward the intruder.

10. An alarm system for detecting an intruder and making a impression on the intruder, comprising:

detection means for detecting a presence of the intruder;

a plurality of sensors placed throughout an area to be protected, and means for calculating a location of the intruder based on output signals transmitted from the sensors;

signaling means for outputting a warning signal for perception by the intruder; and control means for changing the warning signal based on the determined location of the intruder.

11. The alarm system according to claim 10, further comprising means for changing the warning signal based on a predetermined passage of time.

12. The alarm system according to claim 10, further comprising means for changing an audio level of the warning signal gradually so as to give the intruder an impression that an audio source is moving.

13. The alarm system according to claim 10, wherein said detection means comprises an infrared light source and an infrared sensor.

14. The alarm system according to claim 10, wherein said sensor means comprises a plurality of radars.

15. The alarm system according to claim 10, wherein said warning signal is selected from the group consisting of a human voice, a dog voice, and a light source, wherein said control means comprises means for changing the kind of warning signal output based on the determined location of the intruder.

16. An alarm system for detecting an intruder and making an impression on the intruder, comprising:

detection means for detecting a presence of the intruder;

sensor means for determining a location of the intruder;

signaling means for outputting a warning signal for perception by the intruder;

control means for changing the warning signal based on the determined location of the intruder;

means for changing an audio level of the warning signal gradually so as to give the intruder an impression that an audio source is moving; and means for increasing the audio level of the warning signal so as to give the intruder an impression that an audio source is moving toward the intruder.

17. An alarm system for detecting an intruder and making an impression on the intruder comprising:

detection means for detecting a presence of the intruder;

sensor means for determining a location of the intruder;

signaling means for outputting a warning signal for perception by the intruder;

control means for changing the warning signal based on the determined location of the intruder; and means for changing an audio level of the warning signal gradually so as to give the intruder an impression that an audio source is moving;

wherein said means for outputting a warning signal comprises a plurality of speakers, and said control means comprises means for changing a phase and audio level of the warning signal output from a first one of said speakers relative to a phase and audio level of the warning signal output from a second one of said speakers so as to give the intruder an impression that an audio source is moving two dimensionally.

18. The alarm system according to claim 17, wherein said control means comprises means for changing the phase and audio level of the warning signal to give the intruder an impression that an audio source is moving toward the intruder.

* * * * *